US012584229B2

(12) United States Patent
Mohr et al.

(10) Patent No.: US 12,584,229 B2
(45) Date of Patent: Mar. 24, 2026

(54) METHOD FOR APPLYING A CONVERSION COATING WITH AN AQUOUS PICKLING COMPOSITION COMPRISING AN AMINOPHOSPHONIC ACID AND A POLYMER

(71) Applicant: CHEMETALL GMBH, Frankfurt am Main (DE)

(72) Inventors: Anna Verena Mohr, Frankfurt am Main (DE); Marcell Six, Frankfurt am Main (DE); Nawel Souad Khelfallah, Frankfurt am Main (DE)

(73) Assignee: CHEMETALL GMBH, Frankfurt am Main (DE)

( * ) Notice: Subject to any disclaimer, the term of this patent is extended or adjusted under 35 U.S.C. 154(b) by 546 days.

(21) Appl. No.: 18/001,103

(22) PCT Filed: Jun. 4, 2021

(86) PCT No.: PCT/EP2021/064965
§ 371 (c)(1),
(2) Date: Dec. 8, 2022

(87) PCT Pub. No.: WO2021/249878
PCT Pub. Date: Dec. 16, 2021

(65) Prior Publication Data

US 2023/0250537 A1 Aug. 10, 2023

(30) Foreign Application Priority Data

Jun. 10, 2020 (EP) ..... 20179325

(51) Int. Cl.

| | |
|---|---|
| ***C23G 1/24*** | (2006.01) |
| ***C23C 22/18*** | (2006.01) |
| ***C23C 22/78*** | (2006.01) |
| ***C23C 22/83*** | (2006.01) |
| ***C23F 11/167*** | (2006.01) |

(52) U.S. Cl.
CPC ..... *C23G 1/24* (2013.01); *C23C 22/184* (2013.01); *C23C 22/78* (2013.01); *C23C 22/83* (2013.01); *C23F 11/1676* (2013.01); *C23C 2222/20* (2013.01)

(58) Field of Classification Search
CPC ... C11D 3/0057; C11D 3/0073; C11D 3/1226; C11D 3/1266; C11D 3/361; C11D 3/364; C11D 3/393; C11D 9/225; C11D 2111/16
See application file for complete search history.

(56) References Cited

U.S. PATENT DOCUMENTS

| | | | | |
|---|---|---|---|---|
| 4,681,695 | A * | 7/1987 | Divo | C11D 17/0039 252/186.25 |
| 5,712,236 | A * | 1/1998 | Bolkan | C23G 1/16 510/423 |
| 2004/0016059 | A1* | 1/2004 | Dresco | C11D 3/3947 8/115.51 |
| 2010/0078040 | A1 | 4/2010 | Vernier | |
| 2010/0144579 | A1* | 6/2010 | Volkel | C11D 3/3792 510/299 |
| 2015/0353871 | A1* | 12/2015 | Oebro | C12Y 302/01001 510/393 |
| 2016/0010038 | A1* | 1/2016 | Morant | C11D 3/38627 435/252.31 |
| 2018/0148670 | A1* | 5/2018 | O'Connell | C11D 3/38636 |
| 2018/0273881 | A1* | 9/2018 | O'Connell | C12N 9/2402 |
| 2019/0177662 | A1* | 6/2019 | Chaudhari | C03C 23/0075 |

FOREIGN PATENT DOCUMENTS

| | | | |
|---|---|---|---|
| CN | 103771600 | B | 1/2016 |
| CN | 104709982 | A | 1/2016 |
| EP | 2090676 | A1 | 8/2009 |
| JP | H06220647 | A | 8/1994 |
| JP | H07113190 | A | 5/1995 |

OTHER PUBLICATIONS

International Search Report and Written Opinion for corresponding PCT/EP2021/064965 mailed Aug. 31, 2021; 12 pages.

* cited by examiner

*Primary Examiner* — Charles I Boyer
(74) *Attorney, Agent, or Firm* — Armstrong Teasdale LLP

(57) ABSTRACT

Disclosed herein is an aqueous composition having a pH value at 55° C. in the range from 5 to 9, containing at least one different amino organophosphonic acid derivatives of formula (I)

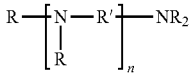

(I)

where residues R independently of each other are $CH_2$—$PO(OR'')_2$, residues R' independently of each other are alkylene residues with 2 to 4 carbon atoms, residues R'' independently of each other are H, Na, K, Li or $NH_4$; and n is an integer from 0 to 4; and at least one copolymer, which is water-soluble or water-dispersible. Further disclosed herein are a concentrate to produce such compositions, a pickling method for pickling metallic substrates making use of the compositions, a coating method for coating metallic substrates including the pickling method and a method of using the compositions for pickling metallic substrates.

11 Claims, No Drawings

METHOD FOR APPLYING A CONVERSION COATING WITH AN AQUOUS PICKLING COMPOSITION COMPRISING AN AMINOPHOSPHONIC ACID AND A POLYMER

CROSS-REFERENCE TO RELATED APPLICATIONS

This application is a U.S. National Phase Application of International Patent Application No. PCT/EP2021/064965, filed Jun. 4, 2021, which claims priority to European Patent Application No. 20179325.4, filed Jun. 10, 2020, each of which is hereby incorporated by reference herein.

The present invention relates to an aqueous, neutral pickling composition for removal of rust and scale in a method for pickling metallic substrates and a concentrate to produce such compositions. The present invention further relates to such method and the use of the compositions for pickling metallic surfaces. Furthermore, the invention relates to a method for coating metallic substrates, particularly to improve corrosion protection.

BACKGROUND

The non-removal of oxide layers and other residuals after thermal treatment of metallic substrates typically raises problems in subsequent conversion coating steps, resulting in a reduced adhesion of subsequent coating layers, particularly coating layers obtained by cathodic electro deposition coating, thus reducing corrosion protection.

Therefore, generally, and particularly in the automotive industry, aqueous cleaning and pickling solutions having rather extreme pH values are used prior to conversion coating. A problem typically associated with highly acidic pickling solutions is that after rinsing the surface there is a tendency of film rust formation. Furthermore, when using highly acidic or highly alkaline compositions, stricter requirements for occupational and industrial safety and safety in transportation must be observed. Moreover, such pickling compositions are more aggressive towards the metallic substrates to be pickled and the equipment.

To overcome such problems, in recent years an increasing number of fluidic, neutral rust and scale removing compositions suitable for iron-based and non-iron metals and alloys, and being applicable in dip methods, flooding methods and spraying methods have been developed. They are suitable to remove oxide layers from metallic surfaces as they occur after thermal deburring, laser cutting and welding operations. Such neutral pickling compositions have many advantages compared to mineral acid based pickling compositions or strong alkaline compositions. Contrary to strong acids and bases, their handling is much easier and it is often possible to clean and pickle the surfaces in one process step. Therefore, an additional cleaning step can often be omitted.

Particularly, neutral compositions based on phosphonic acids such as 1-hydroxyethane-1,1-diphosphonic acid or amino phosphonic acids are used for the above purposes, because they are known to be complexing agents even in an essentially neutral environment. The term "neutral", as used herein, refers to aqueous compositions having a pH value at 55° C. of about 5 to about 9 and thus encompasses slightly acidic as well as slightly alkaline aqueous compositions.

On the other hand, phosphonates are typically not the first choice, when it comes to cleaning and pickling metallic surfaces of different metal composition. This particularly plays a role, when metallic substrates of different composition are to be cleaned and pickled with the same cleaning and pickling composition one after each other or at the same time, in case of pickling pre-assembled metallic components of different metallic composition, such as particularly steel and galvanized steel. This is because phosphonate-based cleaning and pickling solutions often lack a balanced pickling weight loss for different substrates, and have a significantly different effectiveness on the surfaces to be cleaned and pickled, depending on the type of metal or alloy.

WO 2013/156396 A1 relates to the improvement of the cleaning performance of protease containing detergents or cleaning agents with respect to protease-sensitive soiling. These cleaning agents rely on the activity or the proteases. WO 2013/156396 A1 discloses that it is known, that protease containing detergents show an improved cleaning performance, when negatively charged polymers are contained. However, in detergents containing high amounts of surfactants their combination with negatively charged polymers becomes problematic. To overcome problems associated therewith, specific phosphonates were added. The detergent concentrates disclosed in Example 1 of WO 2013/156396 A1 contain a comparably low amount of water compared to the pickling compositions of the present invention, while the detergent in its usage form contains more than 99.8 wt.-% of water. Neither the pH value of these compositions is optimized nor are they made to remove metal oxides from metallic substrates, since their object is to clean textiles and not to pickle metallic surfaces.

Consequently, there is a continuing need for improved aqueous, neutral compositions providing an improved, particularly balanced pickling behavior when used on different substrates and which do not adversely affect subsequent conversion coating processes. Particularly, the adhesion of subsequent coating layers such as electrodeposition coating layers, filler, basecoat and/or clear coat layers should not be deteriorated.

SUMMARY

This need was met by providing an aqueous composition having a pH value at 55° C. in the range from 5 to 9, containing at least one amino organophosphonic acid derivative of formula (I)

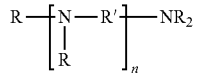

(I)

wherein residues R independently of each other are $CH_2$—PO$(OR'')_2$, residues R' independently of each other are alkylene residues with 2 to 4 carbon atoms, residues R" independently of each other are H, Na, K, Li or $NH_4$; and n is an integer from 0 to 4;

and at least one copolymer, which is water-soluble or water-dispersible and selected from the group consisting of at least partially neutralized poly(meth)acrylic acids and polyvinylpyrrolidones;

the content of water being in the range from 80 wt.-% to 99.5 wt.-%, based on the total weight of the composition.

In the following such composition is called "composition according to the invention" or "pickling composition according to the invention".

The present invention further provides a concentrate containing the ingredients of the composition according to the invention in a higher concentration, which allows the preparation of the composition according to the invention at the place, where it is needed, by dilution with a diluent comprising water and optionally organic solvents and, if necessary, by subsequently adjusting the pH value.

The invention further provides a method for pickling a metallic substrate comprising at least one step of contacting a metallic substrate with a composition according to the invention.

In the following, this method is called "pickling method according to the invention".

Yet another object of the present invention is a method for coating a metallic substrate comprising at least (a) the pickling method according to the invention, followed by
(b) a step of coating the thus pickled metallic substrate with a conversion coating composition, optionally followed by
(c) a step of applying an electrodeposition coating composition; and optionally followed by
(d) one or more steps of applying one or more further coating composition(s).

In the following, this method is called "coating method according to the invention".

A further object of the present invention is the use of the compositions according to the invention for pickling metallic substrates.

In the following, this use is called "use according to the invention".

DETAILED DESCRIPTION

Composition According to the Invention

Since the composition according to the present invention is an aqueous composition, the main ingredient is water. The content of water, based on the total weight of the composition ranges from 80 wt.-% to 99.5 wt.-%, more preferred 85 wt.-% to 99 wt.-%, even more preferred 90 wt.-% to 98.0 wt.-% and most preferred 95 to 97.5 wt.-%.

The composition according to the present invention may also contain minor amounts of one or more organic solvents which are preferably miscible with or dissolve in water. Preferably their amount is 10 wt.-% or less, more preferred less than 5 wt.-% and even more preferred less than 3 wt.-% or less than 1 wt.-%, based on the total weight of the composition according to the present invention. Most preferred the only solvent used in the composition according to the present invention is water.

The compositions according to the invention are preferably aqueous solutions or aqueous dispersions, most preferred aqueous solutions.

Compositions according to the invention generally provide a more balanced pickling, when used for pickling different metallic substrates. The extend of pickling can be compared between different substrates by the determination of the pickling weight loss. The pickling weight loss is the loss of material in $g/m^2$ in the pickling process. The amount should neither be too low, indicating an insufficient pickling nor too high, indicating a surface treatment being too harsh, thus increasing the risk of damaging the surface of the substrate, leading to an uneven surface and thus causing an inferior adhesion of subsequent coating layers.

A sufficient pickling weight loss starts preferably at about 0.5 $g/m^2$ and should preferably not exceed about 2.5 $g/m^2$, whereby exceptions from this range might be acceptable depending on the desired application. A balanced pickling is typically obtained, when the difference in pickling weight loss (Δpwl), comparing different metallic substrates pickled with the same pickling composition, is preferably not larger than about 0.6 $g/m^2$, even more preferred not larger than 0.4 $g/m^2$ and most preferred not larger than 0.3 or 0.2 $g/m^2$. The pickling weight loss, particularly the afore-mentioned values and the (Δpwl) are determined as described in the experimental part of the application. The pickling weight loss values and Δpwl values as mentioned above, preferably apply to CRS (cold rolled steel) and HDG (hot dip galvanized steel) and the comparison of both. However, the pickling compositions according to the invention are also suitable for other substrates.

The Amino Organophosphonic Acid Derivatives of Formula (I)

The composition according to the present invention comprises at least one amino organophosphonic acid derivative of formula (I)

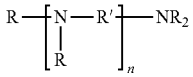

(I)

wherein residues R independently of each other are $CH_2$—$PO(OR'')_2$, residues R' independently of each other are alkylene residues with 2 to 4 carbon atoms, residues R'' independently of each other are H, Na, K, Li or $NH_4$; and n is an integer from 0 to 4.

Preferably the compositions of the present invention comprise at least two different amino organophosphonic acid derivatives of formula (I) differing in the value of n.

It was particularly surprising that organophosphonic acid derivatives of formula (I) could be used in the composition according to the invention, which, if used alone cause an unacceptable high pickling weight loss, while when used in mixture with at least one water-soluble or water-dispersible copolymer as defined above, provide for more balanced pickling results.

To provide aqueous compositions according to the present invention having a pH value at 55° C. being in the range from 5 to 9, it might become necessary to neutralize at least some of the acidic hydrogen atoms present in residue $CH_2$—$PO(OH)_2$ of the free acids, if free acids are employed, thus forming alkali salts or ammonium salts of the amino organophosphonic acids. This is preferably done in situ, i.e. in the already aqueous composition by pH adjustment with KOH, NaOH, LiGH and/or $NH_4OH$, particularly preferred with aqueous solutions of these bases. However, it is also possible to prepare the salts in advance and to dissolve the salts in the aqueous medium. Most preferred R'' are independently selected from H, K and Na.

In formula (I) it is further preferred that R' is an alkylene with 2 or 3 carbon atoms, most preferred R' is $CH_2CH_2$.

Moreover, n is preferably an integer from 0 to 3, even more preferred n=0, 1 or 2 and most preferred 0 or 1.

While all definitions of R, R', R'' and n can independently be combined, it is particularly preferred that residues R independently of each other are $CH_2$—$PO(OR'')_2$, residues R' independently of each other are alkylene residues with 2 or 3 carbon atoms, residues R" independently of each other are H, Na or K; and n is an integer from 0 to 3.

Most preferred residues R independently of each other are $CH_2$—$PO(OR")_2$, residues R' are $CH_2CH_2$, residues R" independently of each other are H, Na or K; and n is 0, 1 or 2 even more preferred n=0 or 1.

Examples of particularly preferred amino phosphonic acids and salts thereof are amino tris(methylene phosphonic acid) (i.e. R=$CH_2$—$PO(OH)_2$, R'=$CH_2CH_2$ and n=0), ethylenediamine tetra(methylene phosphonic acid) (i.e. R=$CH_2$—$PO(OH)_2$, R'=$CH_2CH_2$ and n=1) and diethylenetriamine penta(methylene phosphonic acid) (i.e. R=$CH_2$—$PO(OH)_2$, R'=$CH_2CH_2$ and n=2) and the Li, K, Na and ammonium salts thereof. Amongst the salts of these exemplified amino phosphonic acids the sodium and/or potassium salts are preferred.

It was generally found that a particularly balanced pickling is observed, when using at least two different amino phosphonic acid derivatives of formula (I), and the different values for n do not differ by more than 2, preferably by not more than 1. Thus, if two different amino phosphonic acid derivatives of formula (I) are used, it is preferred that $\Delta n=1$ or 2, preferably $\Delta n=1$.

Water-Soluble or Water-Dispersible Copolymers

The term "copolymer" as used herein refers to polymers composed of at least two different monomers, preferably two different monomers or three different monomers (terpolymers).

The at Least Partially Neutralized Poly(Meth)Acrylic Acids

The term "poly(meth)acrylic acids" as used herein and as commonly used, encompasses "polyacrylic acids", polymethacrylic acids" and "poly(acrylic/methacrylic) acids".

Preferably, the at least partially neutralized poly(meth) acrylic acids are (meth)acrylic acid-maleic acid copolymers. Particularly, the at least partially neutralized poly(meth) acrylic acid is an at least partially neutralized polymer polymerized from a mixture comprising (meth)acrylic acid, maleic acid and/or its anhydride and optionally a carboxy-free monoethylenically unsaturated monomer.

Such (meth)acrylic acid-maleic acid copolymers are preferably alternating copolymers, if no further carboxy-free monoethylenically unsaturated monomer is copolymerized, and preferably possess a molar ratio of acrylic acid to maleic acid being 50:50.

Typically, these copolymers are prepared by free radical polymerization. Since the monomers employed in their synthesis carry just one polymerizable group, i.e. the monoethylenically unsatured group, the copolymers are linear copolymers.

Preferably the weight average molecular weight $M_w$ of the copolymers, determined by gel permeation chromatography (GPC) is in the range from 15,000 to 100,000, more preferred 20,000 to 90,000, even more preferred 30,000 to 80,000, such as 50,000 to 70,000 g/mol. GPC can be carried out according to DIN 55672-3:2016-03. Such products are e.g. commercially available under the trademark Sokalan® from BASF SE, Ludwigshafen, Germany.

It is also possible to use copolymers, which only differ from the afore-mentioned (meth)acrylic acid-maleic acid copolymers in that preferably 0 to 10 mol-%, more preferred 1 to 8 mol-% and most preferred 1 to 5 mol-% of the combined amount (meth)acrylic acid and maleic acid are replaced by a third monoethylenically unsaturated monomer selected from monomers, which do not contain carboxyl groups such as acrylic acid esters or methacrylic acid esters, but which preferably contain a hydrophilic group. The above weight average molecular weight ranges also apply to theses copolymers.

The Polyvinylpyrrolidones

Besides the at least partially neutralized poly(meth) acrylic acids, water-soluble or water-dispersible polyvinylpyrrolidones can be combined with the amino organophosphonic acid derivatives of formula (I) to obtain a balanced pickling effect.

Preferred polyvinylprrolidone copolymers are vinyl acetate-vinyl pyrrolidone copolymers. Particularly, the polyvinylpyrrolidone is preferably polymerized from a mixture of vinyl pyrrolidone and vinyl acetate and optionally a further monoethylenically unsaturated monomer.

Such vinyl acetate-vinyl pyrrolidone copolymers are preferably random copolymers and preferably possess a molar ratio of vinyl acetate to vinyl pyrrolidone from 30:70 to 70:30, more preferred 30:70 to 60:40 and even more preferred from 30:70 to 50:50, such as 40:60.

Typically, these copolymers are prepared by free radical polymerization. Since the monomers employed in their synthesis carry just one polymerizable group the copolymers are linear copolymers.

Preferably the weight average molecular weight $M_w$ of the copolymers, determined by gel permeation chromatography (GPC) is in the range from 15,000 to 100,000, more preferred 20,000 to 90,000, even more preferred 30,000 to 80,000, such as 50,000 to 70,000 g/mol. GPC can be carried out according to DIN 55672-3:2016-03. The polydispersity of the copolymers $M_w/M_n$ is preferably in the range from 3 to 7, more preferred 4 to 6.

It is also possible to use copolymers, which only differ from the afore-mentioned vinyl acetate-vinyl pyrrolidone copolymers in that preferably 0 to 10 mol-%, more preferred 1 to 8 mol-% and most preferred 1 to 5 mol-% of the combined amount vinyl acetate and vinyl pyrrolidone are replaced by a third monoethylenically unsaturated monomer selected from vinyl monomers, acrylate monomers and methacrylate monomers. The above weight average molecular weight ranges also apply to these copolymers.

pH Value

The aqueous compositions according to the present invention have a pH value (determined at 55° C.) in the range from 5 to 9, preferably 5.5 to 8.5, more preferred from 6.0 to 8.0 and most preferred from 6.5 to 7.5.

Amounts of Amino Organophosphonic Acid Derivatives and Water-Soluble or Water-Dispersible Copolymers The compositions according to the invention need to contain at least one amino organophosphonic acid derivative of formula (I).

The amount of all amino organophosphonic acid derivatives of formula (I) preferably ranges from 0.2 to 5.0 wt.-%, more preferred 0.3 to 3.0 wt.-% and most preferred 0.4 to 2.8 wt.-% based on the total weight of the composition according to the invention and being calculated as free acid (i.e. R=$CH_2$—$PO(OH)_2$).

The amount of all water-soluble or water-dispersible copolymers, calculated as free acids in case of the partially neutralized poly(meth)acrylic acids, and as defined for use in the composition according to the invention preferably ranges from 0.05 to 2.0 wt.-%, more preferred 0.10 to 1.0 wt.-% and most preferred 0.15 to 0.5 wt.-% based on the total weight of the composition according to the invention.

All wt.-% ranges used in the context of the total specification do not only apply to the broadest definition of the respective ingredient(s), but also to any further preferred embodiment of the ingredient(s).

The combined amount of all amino organophosphonic acid derivatives of formula (I) contained in the composition according to the invention and of all water-soluble or water-dispersible copolymers, calculated as free acids in case of the partially neutralized poly(meth)acrylic acids, and as defined for use in the composition according to the invention preferably ranges from 0.25 to 7.0 wt.-%, more preferably 0.3 to 3.0 wt.-% and even more preferred 0.4 to 1.5 wt.-% and most preferably from 0.5 to 1.0 wt.-% based on the total weight of the composition of the invention and being calculated as free acids in case of the amino organophosphonic acid derivatives of formula (I) and as free acids (COOH) in case of the at least partially neutralized poly (meth)acrylic acids.

Weight Ratios of Amino Organophosphonic Acid Derivatives to the Water-Soluble or Water-Dispersible Copolymers The weight ratio of the sum of amino organophosphonic acids of formula (I) to the sum of water-soluble or water-dispersible copolymers as defined for the composition according to the present invention is preferably in the range from 1:1 to 30:1, more preferred 1:1 to 10:1, even more preferred from 1:1 to 5:1 and most preferred 1:1 to 3:1.

Further Ingredients

The compositions of the present invention may also contain further ingredients such as additives, such ingredients being necessarily different from the amino organophosphonic acid derivatives of formula (I) and the water-soluble or water-dispersible copolymers as defined for the composition according to the present invention. The further ingredients also differ from water and organic solvents.

If present, such additives typically not interfere with the pickling effect provided by the compositions of the present invention, but add further properties such as an enhanced shelf-life, e.g. obtained by adding preservatives; or an integrated cleaning or degreasing effect e.g. obtained by adding surfactants, preferably non-ionic surfactants.

Unlike household cleaning compositions, such as detergents, particularly laundry detergents, the compositions according to the present invention do not contain proteases, preferably no enzymes at all, because pickling action clearly differs from enzymatic cleavage reaction such as cleavage of protein-based dirt and/or contaminations.

Preferably, the total amount of further ingredients, which differ from the amino organophosphonic acid derivatives of formula (I) and the water-soluble or water-dispersible copolymers as defined for the composition according to the present invention, is less than 50 wt.-%, more preferred less than 40 wt.-%, even more preferred less than 30 wt.-% or less than 20 wt.-%, such as less than 10 wt.-% of the combined amount of ingredients consisting of the further ingredients, the amino organophosphonic acid derivatives of formula (I) and the water-soluble or water-dispersible copolymers as defined for the composition according to the present invention.

Preferably, the compositions according to the invention do not contain other pickling agents or metal ion chelating agents beside the amino organophosphonic acid derivatives of formula (I) and the water-soluble or water-dispersible copolymers as defined for the composition according to the present invention.

Concentrate According to the Invention

The present invention further relates to a concentrate comprising a liquid medium composed of water and/or organic solvents; the amino organophosphonic acid derivatives of formula (I) and the water-soluble or water-dispersible copolymers as defined for the composition according to the present invention; and any further ingredients of the composition according to the invention. The sum of the amount of amino organophosphonic acid derivatives of formula (I); the water-soluble or water-dispersible copolymers as defined for the composition according to the present invention and the optionally contained further ingredients preferably ranges from 10 wt.-% to 90 wt.-% of the total weight of the concentrate, more preferred 20 wt.-% to 90 wt.-%, even more preferred 30 wt.-% to 90 wt.-% or 40 wt-% to 90 wt.-% and most preferred 50 wt.-% to 90 wt.-%, based on the total weight of the concentrate.

The concentrates according to the invention most preferably do not contain proteases and are preferably enzyme-free.

The concentrate allows the preparation of the composition according to the present invention where it is needed, by diluting with a diluent comprising water and optionally organic solvents and, if necessary, followed by subsequently adjusting the pH value at 55° C. in the range from 5 to 9, preferably 5.5 to 8.5, more preferred from 6.0 to 8.0 and most preferred from 6.5 to 7.5. The concentrate is preferably an aqueous concentrate.

Preferably, the dilution ratio is from 1:1 (volume of the concentrate:volume of the diluent) to 1:50, more preferred 1:2 to 1:10 and most preferred 1:3 to 1:5.

Using such concentrates reduces the need of large storage capacities and facilitates transportation to the places of use.

Pickling Method According to the Invention

The pickling method according to the present invention includes at least one step of contacting a metallic substrate with a composition according to the present invention.

Metallic Substrate

The term "metallic substrate" as used herein includes substrates of any shape, such as flat metallic substrates like simple panels or coils, but also metallic substrates with complex shapes like automotive bodies or parts thereof. The term "metallic" as used herein comprises pure metals and metal alloys. Particularly preferred examples of metals and alloys are cold-rolled steel, galvanized steel such as hot-dip galvanized steel or electrolytically galvanized steel and aluminum and its alloys. Particularly preferred substrates are cold-rolled steel and galvanized steel, such as hot-dip galvanized steel. Moreover, the term "substrate" also comprises pre-assembled metal parts, the metal parts being of the same metal or alloy or the metal parts being of at least two different metals or alloys (multi-metal capability of the method).

Contacting the Metallic Substrate with a Composition According to the Invention

The step of contacting a metallic substrate with a composition according to the invention is preferably a step selected from the steps of (a) dipping a metallic substrate into a composition according to the invention,
(b) flooding a metallic substrate with a composition according to the invention; and
(c) spraying a metallic substrate with a composition according to the invention.

While contacting the metallic substrate the composition can be agitated, e.g. by stirring and the like.

The metallic substrate is preferably contacted with the composition according to the invention for period ranging from 1 to 15 min, more preferred a period ranging from 3 to 12 min and most preferred a period ranging from 5 to 10 min.

The temperature of the composition according to the invention during the step of contacting the metallic substrate preferably ranges from 20 to 70° C., more preferred 30 to 65° C. and most preferred 40 to 60° C. such as 50 to 60° C.

Taking into account the maintenance of the temperature of the composition according to the invention in the above ranges and optimizing the contact area of the substrate during contacting, it is most preferred to contact the metallic substrate by dipping the metallic substrate into the composition according to the invention.

Optional Further Steps of the Pickling Method According to the Invention

The pickling method according to the invention can comprise one or more steps prior to the at least one step of contacting a metallic substrate with a composition according to the present invention.

It is to be emphasized that the optional further steps described in the following are not necessarily the only optional steps possible in the pickling method according the invention. Particularly any further cleaning, rinsing and/or drying step may be carried out in addition to the preferred optional steps, if desired.

Particularly, the pickling method may comprise, prior to the at least one step of contacting a metallic substrate with a composition according to the present invention (iv), at least one cleaning step (i) preferably followed by at least one rinsing step (ii), even more preferred followed by two rinsing steps (ii) and (iii).

Therefore, a preferred pickling method according to the present invention comprises (i) a step of contacting a metallic substrate with a cleaning composition, optionally followed by
(ii) a step of rinsing the metallic substrate with a first rinsing composition, optionally followed by
(iii) a step of rinsing the metallic substrate with a second rinsing composition, followed by
(iv) a step of contacting a metallic substrate with a composition according to the present invention.

Step (i) of contacting the metallic substrate with a cleaning composition can be carried out in the same manner as the step of contacting the metallic substrate with a composition according to the present invention except for using the cleaning composition instead of the composition according to the present invention. Most preferred are spray cleaning and/or dip cleaning. The temperature of the cleaning composition used in step (i) is preferably in the range from 20 to 70° C., more preferred 30 to 65° C. and most preferred 40 to 60° C. such as 45 to 60° C. The duration of contacting the metallic substrate with the cleaning composition preferably ranges from 0.5 min to 15 min, more preferred 1 min to 10 min, most preferred 3 min to 5 min.

The cleaning composition preferably has an alkaline pH value in the range from 8 to 12, more preferred 9 to 11, such as 10 to 11 and preferably contains at least one of caustic, phosphonates, surfactants and complexing agents.

Suitable cleaning agents are for example commercially available from Chemetall GmbH (Frankfurt, Germany) under the tradename Gardoclean®.

The rinsing steps (ii) and (iii) are preferably carried out by spray or dip applying, preferably dip applying the respective rinsing compositions. The rinsing compositions are typically water or water containing diluted ingredients of the previous treatment step due to the unavoidable drag over from the previous bath, if dip application is chosen.

The first rinsing composition preferably has a pH value in the range from 9 to 12, due to drag over from the previous cleaning composition and preferably contains all ingredients of the cleaning composition, but water-diluted.

The second rinsing composition preferably has a pH value in the range from 8 to 11, due to the drag over from the first rinsing compositions and preferably contains all ingredients of the first rinsing composition, but water-diluted.

The rinsing steps can also be carried out with water only, particularly in laboratory-scale experiments.

The above sequence of steps (i) to (iv) is also a preferred embodiment of step (a) of the method for coating according to the invention.

The pickling method according to the invention can also comprise one or more steps subsequent to the at least one step of contacting a metallic substrate with a composition according to the present invention (iv), namely one or more rinsing steps (v) to (vii).

Therefore, a preferred pickling method according to the present invention may also comprise (iv) a step of contacting a metallic substrate with a composition according to the present invention, followed by
(v) a step of rinsing the metallic substrate with a third rinsing composition, optionally followed by
(vi) a step of rinsing the metallic substrate with a fourth rinsing composition, and optionally followed by
(vii) a step of rinsing the metallic substrate with a fifth rinsing composition.

The rinsing steps (v), (vi) and (vii) are preferably carried out by spray or dip applying the respective rinsing compositions. The rinsing compositions can just be composed of water, but are typically the water-diluted compositions from the respective previous steps due to the drag over from the respective previous steps. Carrying out the rinsing steps (v) to (vii) is particularly preferred if the pickling method according to the present invention is carried out continuously. In such case an accumulation of iron compounds in the pickling composition occurs if iron containing metallic substrates are pickled. Such iron compound can be washed-off in the respective rinsing step(s).

The above sequence of steps (iv) to (vii) is also a preferred embodiment of step (a) of the method for coating according to the invention.

To keep such iron compounds in solution, it is preferred that the third rinsing composition preferably has an acidic pH value in the range from 1 to 3 and preferably further contains the ingredients of the previous pickling composition, but water-diluted.

To avoid the formation of a rust film after the acidic rinse, the fourth rinsing composition preferably has an alkaline pH value in the range from 9 to 12 and preferably contains caustic plus a complexing agent. Rust film formation may particularly occur, if the pickling method is run as a continuous process and this process is interrupted and/or the time between the steps becomes too long.

If the pickling method according to the present invention is followed particularly by a phosphate conversion coating step, it is preferred that the fifth rinsing composition preferably has a pH value in the range from 9 to 10 and contains the ingredients of the forth rinsing composition, due to drag over, but water-diluted.

Typically, prior to a phosphate conversion coating step an activation step is carried out and prior to this conversion coating step it is neither preferred that the pH value of a rinsing composition is too high or too low. Therefore, it is particularly preferred that the pH value of the fifth rinsing solution is in the afore-mentioned slightly alkaline or neutral range. Particularly preferred in step (vii) is rinsing with water.

Of course, all steps prior to the step of contacting a metallic substrate with a composition according to the present invention and the steps subsequent to the step of contacting a metallic substrate with a composition according to the present invention can be carried out in combination in the pickling method according to the present invention.

In such case, the pickling method according to the invention preferably comprises (i) a step of contacting a metallic substrate with a cleaning composition, optionally followed by
(ii) a step of rinsing the metallic substrate with a first rinsing composition, optionally followed by
(iii) a step of rinsing the metallic substrate with a second rinsing composition, followed by
(iv) a step of contacting the metallic substrate with a composition according to the present invention, followed by
(v) a step of rinsing the metallic substrate with a third rinsing composition, optionally followed by
(vi) a step of rinsing the metallic substrate with a fourth rinsing composition, and optionally followed by
(vii) a step of rinsing the metallic substrate with a fifth rinsing composition.

The cleaning composition, the rinsing compositions and the composition according to the invention being defined as above. The above sequence of steps (i) to (vii) is also a preferred embodiment of step (a) of the method for coating according to the invention.

Coating Method According to the Invention

It is further provided a method for coating a metallic substrate comprising at least (a) the pickling method according to the invention, followed by
(b) a step of coating the thus treated metallic substrate with a conversion coating composition obtaining a conversion coating layer, optionally followed by
(c) a step of applying an electrodeposition coating composition obtaining an electrodeposition coating layer; and optionally followed by
(d) one or more steps of applying one or more further coating composition(s) obtaining one or more further coating layer(s).

It is to be emphasized that the steps of the coating method according to the invention as described above are not necessarily the only steps possible in the coating method according the invention. Particularly any further rinsing, drying and/or curing step(s) may be carried out in addition to the above steps, if desired.

Thus, it is preferred to have at least one rinsing step (b") subsequent to step (b) and prior to step (c). It is also preferred to have at least one rinsing step (c') followed by a curing step (c") subsequent to step (c).

Preferably, the coating obtained in the coating method according to the invention is a multilayer coating. Even more preferred the coating obtained in the coating method according to the invention is a coating comprising a conversion coating layer, an electrodeposition coating layer and preferably at least one further coating layer.

Step (a)

Thus, the coating method according to the invention comprises—as a pretreatment step—at least step (a), i.e. the pickling method according to the invention, particularly at least step (iv) of the pickling method according to the invention.

More preferably step (a) comprised in the coating method according the invention comprises steps (iv), (v), (vi) and (vii) of the pickling method of the invention.

Even more preferred, step (a) comprised in the coating method of the invention comprises steps (i) to (vii) of the pickling method according to the invention.

Step (b)

Generally, any known conversion coating composition can be used in step (b) of the method for coating according to the present invention.

The conversion coating compositions used in the present invention are preferably acidic conversion coating compositions.

Preferably the conversion coating compositions used in the method for coating according to the present invention are selected from i. phosphate conversion coating compositions, such as Ni-containing and Ni-free zinc phosphating compositions and trication phosphating compositions, the phosphate conversion coating compositions containing zinc ions and at least one of manganese ions and nickel ions,
ii. organosilane based conversion coating compositions containing at least one organosilane and/or its hydrolysis products and/or its condensation products; and
iii. passivating conversion coating compositions containing at least one compound selected from the groups of zirconium compounds, titanium compounds and hafnium compounds.

If a phosphate conversion step, particularly a zinc phosphating step or a trication phosphating step is carried out as step (b), it is preferred to carry out an additional activation step (a') after step (a) and prior to step (b). If carried out, the activation step (a') is carried out by contacting the metallic substrate subsequent to step (a) and prior to step (b) with an activation composition. Contacting is preferably carried out by dipping, flooding or spraying as descripted for contacting a metallic substrate with the composition according to the invention. Most preferred is contacting the metallic substrate by dip application of the activation composition. The duration of the contacting step with the activation composition preferably ranges from 5 to 300 seconds, more preferred 10 to 200 seconds and most preferred 20 to 90 seconds such as 30 to 60 seconds. Activation compositions or solutions are for example available from Chemetall GmbH (Frankfurt, Germany) under the trademark Gardolene® V and Gardolene® ZL.

If an activation step is carried out, the activation composition used therein preferably contains zinc phosphate crystals and/or titanium phosphate crystals, which facilitate the deposition of the phosphate conversion layer.

If a phosphate conversion step, particularly a zinc phosphating step or a trication phosphating step is carried out as step (b), it is preferred to carry out an additional passivation step (b') after step (b) and prior to step (c). Passivation compositions are for example available from Chemetall GmbH (Frankfurt, Germany) under the trademark Gardolene® D.

Amongst the zinc phosphating compositions, Ni-containing compositions may be employed. However, for environmental reasons, Ni-free zinc phosphating conversion coating compositions are preferred, which contain Zn ions and Mn ions. A further variant of zinc phosphating conversion coating compositions are the so-called trication phosphate conversion coating compositions containing Zn, Mn and Ni ions. Phosphate conversion coating compositions are for example available from Chemetall GmbH (Frankfurt, Germany) under the trademark Gardobond®.

Organosilane-based conversion coating compositions preferably contain at least one organosilane, the term "organosilane" including its hydrolysis products and condensation products, and optionally compounds selected from the group of zirconium compounds, titanium compounds and hafnium compounds. Such compositions are for example available from Chemetall GmbH (Frankfurt, Germany) under the trademark Oxsilan® to produce thin-film systems.

Passivating conversion coating compositions preferably contain at least one compound selected from the groups of zirconium compounds, titanium compounds and hafnium compounds, more preferably a fluoro complex of titanium, zirconium and/or hafnium. Such conversion coating compositions optionally contain one or more organosilanes the term "organosilane" including its hydrolysis products and condensation products.

Step (c)

In step (c) an electrodeposition coating composition is applied to the conversion coating layer formed in step (b). Electrodeposition coating compositions are aqueous coating compositions which are applied by dip coating, i.e. dipping the pickled, conversion coated metallic substrate into the electrically conductive, aqueous electrodeposition coating composition and applying a direct voltage between the substrate and a counter electrode.

The electrodeposition coating composition is an anodic or cathodic electrodeposition coating composition, preferably a cathodic electrodeposition coating composition.

Cathodic electrodeposition coating compositions are preferably selected from epoxy-type and poly(meth)acrylate-type electrodeposition coating compositions. They are applied according to the coating manufacturers specifications.

Subsequent to step (c) the formed electrodeposition coating layer is preferably rinsed (step (c')) and cured (step (c")) according to the paint manufacturers specifications.

Step (d) or Steps (d)

Subsequent to the electrodeposition coating step (c) it is preferred to apply one or more further coating compositions. Such further coating compositions are preferably selected from water-based coating compositions, solvent-borne coating compositions or UV-curing coating compositions. However, so-called powder coating compositions can also be applied.

Particularly preferred at least one of a filler coating composition, a basecoat composition and a clear coat composition is applied. If a plurality of coating layers is applied (i.e. at least two coating compositions), the application can be carried out wet-in-wet and afterwards the coating layers can be cured simultaneously. However, it is also possible to carry out drying steps and/or curing steps between the application of at least some or all of the plurality of coating compositions as may be used in step(s) (d).

The method for coating metallic substrates according to the invention provides well adhering, corrosion-resistant coatings, preferably multilayer coatings.

Use According to the Invention

The invention further provides the use of the compositions according to the invention for pickling metallic substrates, the metallic substrates being the metallic substrates as described above.

The compositions and their use provide for a balanced and mild, but sufficiently high pickling, if applied to different metallic substrates, thus allowing to pickle different metallic substrates with the same pickling composition one after each other, or if desired, in form of pre-assembled parts comprising different metallic substrates.

In the following the invention will be further explained by providing working examples.

EXAMPLES

Testing Procedures

Determination of the Pickling Weight Loss

Two test panels made of CRS (cold-rolled steel) and HDG (hot dip galvanized steel) were in each case weighed before treatment with one of the pickling solutions.

After pickling, all panels were rinsed with deionized water, dried and weighed. The weight loss caused by the treatment with pickling solution (i.e. the pickling weight loss) in each case represents the removal of material. In each case the average of the three panels was calculated.

The pickling weight loss should preferably not exceed 2.5 $g/m^2$, because surface defects are likely to occur resulting in insufficient adhesion of any subsequent coating layers. Furthermore, the pickling weight loss should preferably not be below 0.5 $g/m^2$, because otherwise insufficient pickling is likely.

A balanced pickling weight loss for a specific pickling composition is achieved, if the difference in pickling weight loss for CRS and HDG is 0.6 $g/m^2$ or less and the pickling weight loss for both materials is in the range from 0.5 $g/m^2$ to 2.5 $g/m^2$.

Determination of the Conversion Coating Layer Weight

The conversion layer weight for the pickled zinc phosphatized metallic substrates is determined by XRF analysis and expressed in $g/m^2$, calculated as $P_2O_5$.

In case of the pickled zinc phosphatized metallic substrates, the conversion layer weight is supposed to be good, if it does not exceed 4.0 $g/m^2$ for CRS and if it does not exceed 3.5 $g/m^2$ for HDG.

The conversion layer weight for the pickled Oxsilan® treated metallic substrates is determined by XRF analysis and expressed in $mg/m^2$, calculated as Zr.

In case of the pickled Oxsilan® 9832 treated metallic substrates, the conversion layer weight is supposed to be good, if it does not exceed 150 $g/m^2$ for CRS and if it does not exceed 150 $g/m^2$ for HDG.

Cross-Cut Adhesion Test

The pickled, conversion coated and electrodeposition coated metallic substrates were subjected to the cross-cut adhesion test according to DIN EN ISO 2409.

If no delamination is observed, the results are rated "0", complete delamination is rated "5". All other grades of delamination are between "0" and "5". An acceptable delamination is rated "0" or "1". The results are average results from two panels.

Electrochemical Delamination Test

The pickled, conversion coated and electrodeposition coated metallic substrates were subjected to the electrochemical delamination test according to the current AA-0175 norm from BMW.

Delamination is measured in millimeter [mm]. An acceptable delamination is less 2 mm. The results are average results from two panels.

Preparation Examples

Pickling of Metallic Substrates

Pickling for the Determination of the Pickling Weight Loss

Panels made of CRS (cold-rolled steel) and HDG (hot dip galvanized steel) were cleaned with an aqueous solution of Gardoclean® S5411 (20 g/L; pH value 10.5) at a temperature of 55° C. for 3 min by spray cleaning and 5 min by dip cleaning. Afterwards the panels were rinsed with water containing the ingredients of the drag over of the previous composition (cleaner bath).

Two panels in each case were immersed for 10 minutes in a bath comprising one of the inventive pickling compositions I1 and I2; or one of the comparative pickling compositions C1, C2 or C3 (see Table 1). The compositions were aqueous solutions of compounds A, B or C (comparative); or aqueous solutions of inventive mixtures of compounds A and B (I1), and B, C and E (I2), as shown in Table 1. The baths had a temperature of 55° C. The panels were rotated at a speed of 250 rpm.

TABLE 1

| Pickling Composition | Compound(s) | Amount [wt.-%] | pH value[1] |
|---|---|---|---|
| C1 | A | 0.4 | 7.5 |
| C2 | B | 1.3 | 7.5 |
| C3 | C | 1.3 | 7.5 |
| I1 | A | 0.2 | 7.5 |
| | B | 0.5 | |
| I2 | B | 1.3 | 7.5 |
| | C | 1.3 | |
| | D | 0.2 | |

[1]adjusted by addition of a 50 wt.-% KOH solution in water

A: copolymer based on acrylic acid, maleic acid and a carboxy-free, hydrophilic ethylenically unsaturated monomer B: compound of formula (I) with R = $CH_2$—$PO(OH)_2$, R' = $CH_2CH_2$ and n = 0

C: compound of formula (I) with R = $CH_2$—$PO(OH)_2$, R' = $CH_2CH_2$ and n = 1

D: vinyl acetate-vinyl pyrrolidone (40:60) copolymer (molar ratio)

After pickling the panels, the panels were taken out of the baths and rinsed with water containing some drag over from the previous step. The thus pickled panels were dried and used to determine the pickling weight loss according to the above described procedure.

Pickling as Pretreatment Before Carrying Out the Coating Steps

Further panels made of CRS and HDG, respectively, were cleaned and rinsed as described above and subsequently immersed for 5 and 10 minutes, respectively, in a bath comprising one of the pickling compositions as shown in Table 2. The pickling compositions are inventive aqueous solutions of mixtures of compounds B and C (I3) and A and E (I4) in the respective amounts. The baths had a temperature of 55° C. and was stirred at a speed of 250 rpm.

TABLE 2

| Pickling Composition | Compound(s) | Amount [wt.-%] | pH value[1] |
|---|---|---|---|
| I3 | A | 0.2 | 6.8 |
| | B | 0.5 | |
| I4 | A | 0.2 | 6.8 |
| | E | 0.5 | |

[1]adjusted by addition of KOH solution in water

A: copolymer based on acrylic acid, maleic acid and a carboxy-free monomer

B: compound of formula (I) with R = $CH_2$—$PO(OH)_2$, R' = $CH_2CH_2$ and n = 0

E: compound of formula (I) with R = $CH_2$—$PO(OH)_2$, R' = $CH_2CH_2$ and n = 2

The thus pickled panels were first rinsed with slightly acidic water and subsequently rinsed with alkaline water prior to conversion coating the thus pickled metallic substrates were used wet before carrying out conversion coating.

Conversion Coating of Pickled Metallic Substrates

The pickled test panels made of CRS and HDG (pickled with the pickling composition according to Table 2) were in each case contacted with either a zinc phosphate based conversion coating composition (available from Chemetall GmbH, Frankfurt, Germany) or a silane based conversion coating compositions (Oxsilan® 9832, commercially available from Chemetall GmbH, Frankfurt, Germany).

Zinc Phosphating Conversion Coating

The panels to be coated with the zinc phosphate conversion coating composition were activated with Gardolene® V 6559 (commercially available from Chemetall GmbH, Frankfurt, Germany) by dipping the panels into a 1 g/L solution of Gardolene® V 6559 for 30 to 60 s at room temperature (about 23° C.).

Zinc phosphating was carried out by dip coating the activated panels into Gardobond® 24 T (commercially available from Chemetall GmbH, Frankfurt, Germany) for 3 min at 55° C.

Subsequently, the panels coated with the zinc phosphate conversion coating composition were passivated with Gardolene® D 6800/8 (commercially available from Chemetall GmbH, Frankfurt, Germany) by dipping the panels into a 2.1 g/L solution of Gardolene® D 6800/8 (pH 4.3) for 30 seconds at room temperature (about 23° C.).

Silane-Based Conversion Coating

The panels to be coated with the silane-based conversion coating composition were neither activated prior to conversion coating, nor passivated after conversion coating.

To produce the conversion coating layers, the pickled panels were dipped in a bath comprising the Oxsilan® conversion coating composition (Oxsilan® 9832) for 3 min at a temperature of 32° C.

After conversion coating and prior to electrodeposition coating the conversion coated, pickled metallic substrates were rinsed with deionized water.

The thus conversion coated panels were subjected to the determination of the conversion layer weight as described above.

Electrodeposition Coating of the Conversion Coated, Pickled Metallic Substrates

The conversion coated, pickled CRS panels were subjected to electrodeposition coating with CathoGuard® 800 electrodeposition coating composition, which is commercially available from BASF Coatings GmbH (Minster-Hiltrup, Germany).

The thus electrodeposition coated panels were rinsed and dried in the oven at a temperature of 175° C. for 15 min and ended up with a thickness of 18-22 μm prior to cross-cut testing and electrochemical delamination testing as described above.

Test Results

Table 3 below shows the results from the pickling weight loss determination and confirms that the inventive mixtures show a mild, but sufficient pickling, all in the range of 0.7 $g/m^2$ to 0.9 $g/m^2$ on both, CRS and HDG, and an excellent balance in pickling weight loss of just 0.1 $g/m^2$.

To the contrary, using the pickling solutions comprising only the polymer (C1) or only the amino organophosphonic acid derivative of formula (I) (C3), show an insufficient pickling, or in case of C2 an aggressive pickling on HDG accompanied by an unbalanced pickling.

TABLE 3

| Pickling | Pickling Weight Loss [$g/m^2$] | | Δ Pickling Weight |
|---|---|---|---|
| Composition | CRS | HDG | Loss [$g/m^2$] |
| C1 | 0.2 | 0.1 | 0.1 |
| C2 | 0.7 | 7.5 | 6.8 |
| C3 | 0.5 | 0.3 | 0.2 |
| I1 | 0.7 | 0.8 | 0.1 |
| I2 | 0.9 | 0.8 | 0.1 |

The results shown in Table 4 below reflect the weight of the zinc phosphate conversion layers in $g/m^2$ calculated as $P_2O_5$ obtained on CRS and HDG panels, pickled for 5 and 10 min respectively. The target value is preferably 4 g/m$^2$ or below for CRS and below 3.5 g/m$^2$ for HDG, which is observed in all cases, when pickling is carried out for 5 min and 10 min.

TABLE 4

| Pickling | Conversion Layer Weight/ Zinc Phosphate Conversion [g/m$^2$] | |
|---|---|---|
| Composition | CRS (5 min/10 min) | HDG (5 min/10 min) |
| I3 | 3.4/4.0 | 3.2/3.0 |
| I4 | 3.0/3.7 | 3.2/3.2 |

The results shown in Table 5 below reflect the weight of the Oxsilan® 9832 conversion layers in g/m$^2$ calculated as Zr obtained on CRS and HDG panels, pickled for 5 and 10 min, respectively. The target value is preferably below 150 g/m$^2$ for CRS and HDG, which is observed in all cases, when pickling is carried out for 5 and 10 min.

TABLE 5

| Pickling | Conversion Layer Weight/Oxsilan ® 9832 Conversion [g/m$^2$] | |
|---|---|---|
| Composition | CRS (5 min/10 min) | HDG (5 min/10 min) |
| I3 | 107/106 | 64/68 |
| I4 | 100/85 | 60/64 |

Table 6 shows the cross-cut adhesion test results obtained for CRS panels, pickled for 5 and 10 min, respectively, and conversion coated with Oxsilan® 9832 before applying, rinsing, drying and curing a CathoGuard® 800 cathodic electrodeposition coating layer. As all examples show, no adhesion failure is observed for any sample.

TABLE 6

| Pickling Composition | Cross Cut Adhesion Test Results after Electrodeposition Coating with CathoGuard ® 800 CRS/Oxsilan ® 9832 (5 min/10 min) |
|---|---|
| I3 | 0/0 |
| I4 | 0/0 |

Table 7 shows the results from the electrochemical delamination test on CRS/Oxsilan® 9832.

TABLE 7

| Pickling Composition | Electrochemical Delamination in [mm] CRS/Oxsilan ® 9832 (5 min) |
|---|---|
| I3 | <1 |
| I4 | <1 |

Thus, Tables 6 and 7 show that the coating layers applied to inventively pickled metallic substrates possess a perfect adhesion in the cross-cut adhesion test as well as the electrochemical delamination test. A good delamination value is a value <2.0 mm. Both samples show very good values below 1 mm.

The invention claimed is:

1. A method for coating a metallic substrate with a conversion coating comprising the steps of:

A) pickling the metallic substrate by contacting the metallic substrate with an aqueous pickling composition having a pH value at 55° C. in the range of from 5 to 9, said composition comprising:

a) at least one amino organophosphonic acid derivative of formula (I)

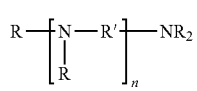

(I)

wherein:

residues R independently of each other are $CH_2$—PO$(OR'')_2$, residues R' independently of each other are alkylene residues with 2 to 4 carbon atoms, residues R" independently of each other are H, Na, K, Li or NH4; and n is an integer from 0 to 4;

b) at least one copolymer, which is water-soluble or water-dispersible and selected from the group consisting of at least partially neutralized poly(meth) acrylic acids and polyvinylpyrrolidones; and c) from 80 to 99.5 wt. % water, based on the total weight of the composition, wherein the aqueous pickling composition does not comprise enzymes, followed by B) a step of coating the thus pickled metallic substrate with a conversion coating composition, optionally followed by C) a step of applying an electrodeposition coating composition; and optionally followed by D) one or more steps of applying one or more further coating composition(s).

2. The method for coating a metallic substrate according to claim 1, wherein the conversion coating composition used in step (b) is selected from the group consisting of i. phosphate conversion coating compositions containing zinc ions and at least one of manganese ions and nickel ions, ii. organosilane based conversion coating compositions containing at least one organosilane and/or its hydrolysis products and/or its condensation products; and iii. passivating conversion coating compositions containing at least one compound selected from the groups of zirconium compounds, titanium compounds and hafnium compounds; and in case of using a phosphate conversion coating composition, the pickled metallic substrate obtained in step (a) is contacted with an activation composition comprising zinc phosphate crystals and/or titanium phosphate crystals prior to carrying out step (b); and in case of using a phosphate conversion coating composition, the conversion coated metallic substrate obtained in step (b) is contacted with a passivation composition comprising at least one compound selected from the group consisting of zirconium compounds, titanium compounds and hafnium compounds.

3. The method for coating a metallic substrate according to claim 1, wherein the electrodeposition coating composition used in step (c) is selected from the group consisting of anodic and cathodic electrodeposition coating compositions; and in case of using cathodic electrodeposition coating compositions the cathodic electrodeposition coating compositions are selected from the group consisting of epoxy-type electrodeposition coating compositions and poly(meth) acrylate-type electrodeposition coating compositions; and subsequently to step (c), drying and curing the electrodeposition coating.

4. The method for coating a metallic substrate according to claim 1, wherein the further coating compositions used in step (d) are selected from the group consisting of filler compositions, basecoat compositions and clear coat coating compositions.

5. The method according to claim 1, wherein R' is $CH_2CH_2$, R" is selected from the group consisting of H, K and Na; and n is 0, 1 or 2.

6. The method according to claim 1 wherein the at least partially neutralized poly(meth)acrylic acid is an at least partially neutralized polymer polymerized from a mixture comprising (meth)acrylic acid, maleic acid and/or its anhydride and optionally a carboxy-free monoethylenically unsaturated monomer; and the polyvinylpyrrolidone is polymerized from a mixture of vinyl pyrrolidone and vinyl acetate and optionally a further monoethylenically unsaturated monomer.

7. The method according to claim 6, wherein the at least partially neutralized polymer is a polymer comprising (meth)acrylic acid and maleic acid and 0 to 10 mol-% of the combined amount of (meth)acrylic acid and maleic acid are replaced by a third monoethylenically unsaturated monomer selected from the group consisting of monomers, which do not contain carboxyl groups and/or the at least partially neutralized poly(meth)acrylic acid has a weight average molecular weight from 15,000 to 100,000 g/mol (determined by gel permeation chromatography); and/or wherein the polyvinylpyrrolidone is a random polymer wherein the molar ratio of vinyl acetate to vinyl pyrrolidone from 30:70 to 70:30, and 0 to 10 mol-% of the combined amount of vinyl acetate and vinylpyrrolidone are replaced by a third monoethylenically unsaturated monomer selected from the group consisting of vinyl monomers, acrylate monomers and methacrylate monomers; and/or the polyvinylpyrrolidone has a weight average molecular weight from 15,000 to 100,000 g/mol (determined by gel permeation chromatography).

8. The method according to claim 1, wherein the aqueous composition has a pH value of from 6.0 to 8.0.

9. The method according to claim 1, wherein the amount of all amino organophosphonic acid derivatives of formula (1) ranges from 0.2 to 5.0 wt.-% based on the total weight of the composition and being calculated as free acid; and/or wherein the amount of all water-soluble or water-dispersible copolymers, calculated as free acids in case of the partially neutralized poly(meth)acrylic acids ranges from 0.05 to 2.0 wt.-% based on the total weight of the composition.

10. The method according to claim 1, wherein the total amount of further ingredients, which differ from the amino organophosphonic acid derivatives of formula (1) and which differ from the water-soluble or water-dispersible copolymers, calculated as free acids in case of the partially neutralized poly(meth)acrylic acids is less than 50 wt.-% of the combined amount of ingredients consisting of the further ingredients, the amino organophosphonic acid derivatives of formula (I) and the water-soluble or water-dispersible copolymers, calculated as free acids in case of the partially neutralized poly(meth)acrylic acids.

11. The method according to claim 1, wherein the metallic substrate is selected from the group consisting of steel, galvanized steel and aluminum and its alloys.

* * * * *